US010743718B2

(12) United States Patent
Taylor

(10) Patent No.: US 10,743,718 B2
(45) Date of Patent: Aug. 18, 2020

(54) BABY BATH SYSTEM

(71) Applicant: Norman J. Taylor, Fairborn, GA (US)

(72) Inventor: Norman J. Taylor, Fairborn, GA (US)

( * ) Notice: Subject to any disclaimer, the term of this patent is extended or adjusted under 35 U.S.C. 154(b) by 0 days.

(21) Appl. No.: 15/911,066

(22) Filed: Mar. 2, 2018

(65) Prior Publication Data

US 2018/0310777 A1 Nov. 1, 2018

Related U.S. Application Data

(60) Provisional application No. 62/491,241, filed on Apr. 27, 2017.

(51) Int. Cl.

| | |
|---|---|
| ***A47K 3/164*** | (2006.01) |
| ***A47K 3/024*** | (2006.01) |
| ***A47K 3/034*** | (2006.01) |

(52) U.S. Cl.

CPC ..... *A47K 3/164* (2013.01); *A47K 3/024* (2013.01); *A47K 3/034* (2013.01)

(58) Field of Classification Search

CPC ..... A47K 3/024; A47K 3/034; A47K 3/064; A47K 3/074; A47K 3/127; A47K 3/164; A47C 4/12; A47C 4/22

USPC ..... 297/344.18, 129

See application file for complete search history.

(56) References Cited

U.S. PATENT DOCUMENTS

| | | | | |
|---|---|---|---|---|
| 4,946,180 | A * | 8/1990 | Baer | A47D 1/008 280/39 |
| 5,181,284 | A | 1/1993 | Raphael | |
| 5,193,487 | A * | 3/1993 | Vogel | A01K 13/001 119/671 |
| 5,592,702 | A * | 1/1997 | Gillebaard, Jr. | E04H 4/0056 4/506 |
| 5,966,752 | A | 10/1999 | Abugideiri | |
| 5,974,601 | A * | 11/1999 | Drane | A47K 3/001 4/539 |
| 6,507,959 | B1 | 1/2003 | Sundberg | |
| 7,032,259 | B1 * | 4/2006 | Kilion | A47K 3/064 220/629 |
| 7,979,925 | B2 * | 7/2011 | Karbowski | A47K 3/127 4/572.1 |
| 8,069,821 | B1 * | 12/2011 | Green | A01K 13/001 119/671 |
| 9,545,176 | B1 * | 1/2017 | Finell | A47K 3/06 |
| 9,642,499 | B2 * | 5/2017 | Schwartz | A47K 3/034 |

* cited by examiner

*Primary Examiner* — Erin Deery

(74) *Attorney, Agent, or Firm* — Acumen Intellectual Property; Michael C. Balaguy

(57) ABSTRACT

A baby bath system including a bathing station assembly having a tub including an inner-volume, a plurality of side walls, an open top end, and a base, a shower head, a plurality of height adjustable legs each having a length, a first-end, and a second-end, a dispenser, a hose, and a drain. The plurality of height adjustable legs may be adjusted to allow a user to access the tub at a desired height without back strain. The device provides parents and guardians with a fully adjustable tub making it easier to bathe an infant.

1 Claim, 5 Drawing Sheets

BABY BATH SYSTEM

CROSS REFERENCE TO RELATED APPLICATION

The present application is related to and claims priority to U.S. Provisional Patent Application No. 62/491,241 filed Apr. 27, 2017, which is incorporated by reference herein in its entirety.

BACKGROUND OF THE INVENTION

The following includes information that may be useful in understanding the present disclosure. It is not an admission that any of the information provided herein is prior art nor material to the presently described or claimed inventions, nor that any publication or document that is specifically or implicitly referenced is prior art.

1. Field of the Invention

The present invention relates generally to the field of baths and more specifically relates to infant baths.

2. Description of Related Art

Many people bathe their children. A bath may be practiced for personal hygiene, or therapeutic purposes. Bathing or body washing can take place in any situation where there is water, ranging from warm to cold. It can take place in a bathtub or shower. It is important for parents to help children maintain cleanliness until they are capable of doing so on their own. Bathing an infant or young child can be difficult. Parents have to bend down and bathe the child which may cause extensive back pains and aches. Having to repeat this process on a daily basis can be painful, difficult, and frustrating for parents. An effective solution is desired.

U.S. Pat. No. 5,966,752 to Fatima Abugideiri relates to a baby bathtub and shower. The described baby bathtub and shower includes a baby bath including a tub and a showerhead. The baby bath also includes a hose capable of connecting to a water source allowing for a flow of water. The hose may be located in a circumference of the tub or connected to the showerhead.

BRIEF SUMMARY OF THE INVENTION

In view of the foregoing disadvantages inherent in the known bathing means art, the present disclosure provides a novel baby bath system. The general purpose of the present disclosure, which will be described subsequently in greater detail, is to provide an adjustable baby bathing device for reducing a strain on a user's back.

A baby bath system is disclosed herein. The baby bath system includes a bathing station assembly including a tub having an inner-volume, a plurality of side walls, an open top end, and a base, a shower head, a plurality of height adjustable legs each having a length, a first-end, and a second-end, a dispenser, a hose, and a drain. In a preferred embodiment, the tub is fully adjustable and comprises an adjustable length and an adjustable depth allowing a parent to fully adjust the tub to accommodate a child. Each of the plurality of height adjustable legs may comprise a suction cup at a respective second-end of the leg(s) to secure the tub in a safe position. The shower head includes a shower-head-hose connecting the shower head to the tub. The hose is a universal water filler and is configured to attach to a bathtub faucet and fill the tub for use. The dispenser is a liquid-dispenser for dispensing the at least one liquid such as soap or shampoo.

For purposes of summarizing the invention, certain aspects, advantages, and novel features of the invention have been described herein. It is to be understood that not necessarily all such advantages may be achieved in accordance with any one particular embodiment of the invention. Thus, the invention may be embodied or carried out in a manner that achieves or optimizes one advantage or group of advantages as taught herein without necessarily achieving other advantages as may be taught or suggested herein. The features of the invention which are believed to be novel are particularly pointed out and distinctly claimed in the concluding portion of the specification. These and other features, aspects, and advantages of the present invention will become better understood with reference to the following drawings and detailed description.

BRIEF DESCRIPTION OF THE DRAWINGS

The figures which accompany the written portion of this specification illustrate embodiments and methods of use for the present disclosure, a baby bath system, constructed and operative according to the teachings of the present disclosure.

The various embodiments of the present invention will hereinafter be described in conjunction with the appended drawings, wherein like designations denote like elements.

DETAILED DESCRIPTION

As discussed above, embodiments of the present disclosure relate to a bath and more particularly to a baby bath system as used to improve the efficiency and safety of bathing of infants.

Generally, the present invention provides parents and guardians with a bath tub featuring adjustable legs, making it much easier to bathe an infant and/or young child(ren). It includes suction cups on the legs to stabilize the bathtub during use. It features hoses for filling the tub with water and for draining the tub once finished. The drain is on the bottom of the bathtub and the hose that rinses the baby's hair is snapped on the side of the tub, the length of the tub. It prevents backaches and strains typically associated with bending down to a regular tub in order to bathe infants and young children. The present invention allows the bathtub to be stored easily and compactly via the retractable legs.

Baby bath system is a child's bath tub with adjustable legs, offering a more convenient bathtub for bathing infants and young children. The device is comprised of a tub unit with adjustable legs and hoses. The legs can feature suction cups on the bottom in order to stabilize the tub while in use.

The hoses can fill and drain the tub with water. Parents/guardians can set up the bathtub as needed. The legs can be adjusted to a comfortable height to allow parents to bathe the child at a comfortable level. Parents can avoid back aches and strain while effectively bathing the child. The tub can be drained via the hoses once bath time is finished. The legs can be retracted and the tub can be stored compactly. No Sweat Baby Bath can be constructed using plastic and other suitable materials. The tub is an adjustable tub from newborn to 50-pounds and the hose that fills the tub is a universal hose that will fit any regular bathtub faucet in order to accommodate all user needs and preferences.

Figure 1:
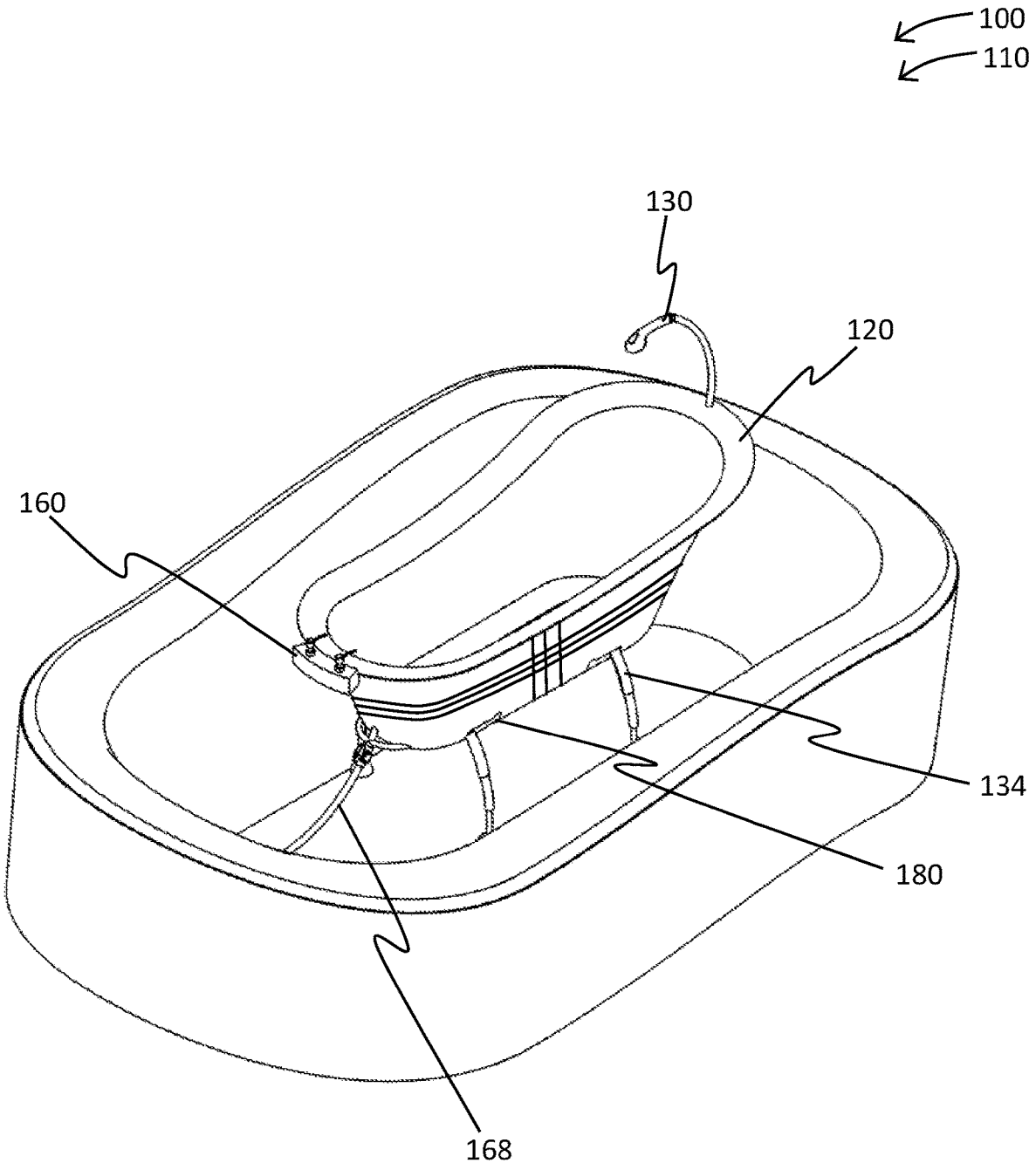
FIG. 1 is a perspective view of the baby bath system, according to an embodiment of the disclosure.

Referring now more specifically to the drawings by numerals of reference, there is shown in FIGS. 1-5, various views of a baby bath system 100. FIG. 1 shows a baby bath system 100 during an 'in-use' condition 150, according to an embodiment of the present disclosure. As illustrated, the baby bath system 100 may include a bathing station assembly 110 including a tub 120 having an inner-volume 122, a plurality of side walls 124, an open top end 126, and a base 128, a shower head 130, a plurality of height adjustable legs 134 each having a length, a first-end 136, and a second-end 138, a dispenser 160, a hose 168, and a drain 170.

The bathing station assembly 110 comprises the tub 120, the shower head 130, the plurality of height adjustable legs 134, the dispenser 160, the hose 168 and the drain 170. The tub 120 is defined by the inner-volume 122, the plurality of side walls 124, the open top end 126, and the base 128. Each of the plurality of height adjustable legs 134 include the length defined between the first-end 136 and the second-end 138. The inner-volume 122 of the tub 120 is configured to be filled with water via the hose 168 when the hose 168 is connected to a water source during use. The drain 170 is configured at the base 128 of the tub 120. The dispenser 160 is configured to dispense at least one liquid. The plurality of height adjustable legs 134 are fixed to opposing corners of the tub 120 at the first-end 136 to provide stable support to the tub 120.

Figure 2:
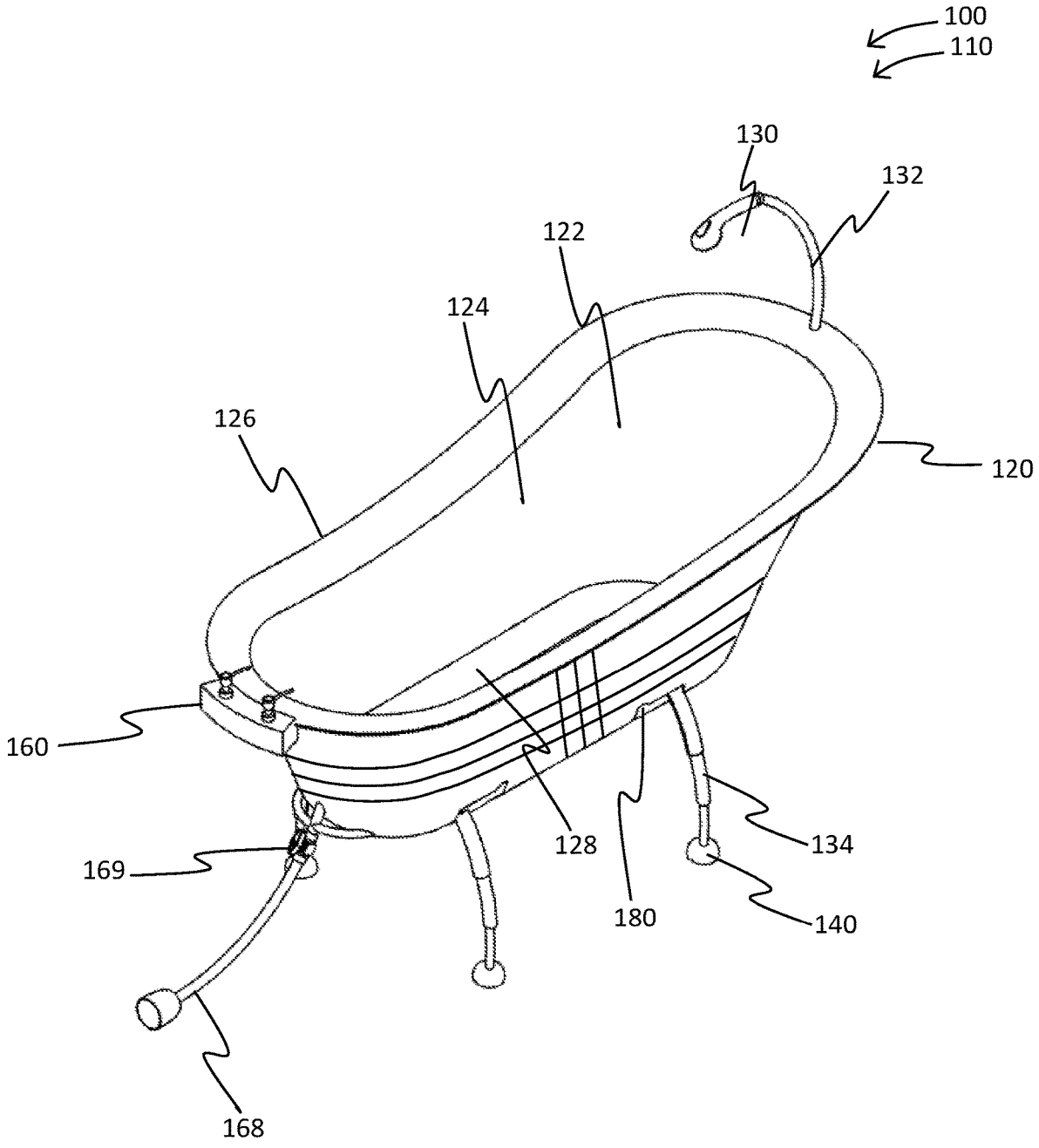
FIG. 2 is a perspective view of the baby bath system of FIG. 1, according to an embodiment of the present disclosure.

FIG. 2 shows a perspective view of the baby bath system 100 of FIG. 1, according to an embodiment of the present disclosure. As above, the baby bath system 100 may include the tub 120, the shower head 130, the plurality of height adjustable legs 134, the dispenser 160, the hose 168, and the drain 170. In a preferred embodiment, the tub 120 comprises an adjustable length and an adjustable depth allowing a parent to fully adjust the tub 120 to accommodate a child. Each of the plurality of height adjustable legs 134 comprise a suction cup 140 at a respective the second-end 138. Each of the plurality of height adjustable legs 134 are telescopic and retractable. Each of the plurality of height adjustable legs 134 are retracted during a non-use condition and extended during an in-use condition. Each of the plurality of height adjustable legs 134 vertically extend from the base 128 of the tub 120.

Figure 3:
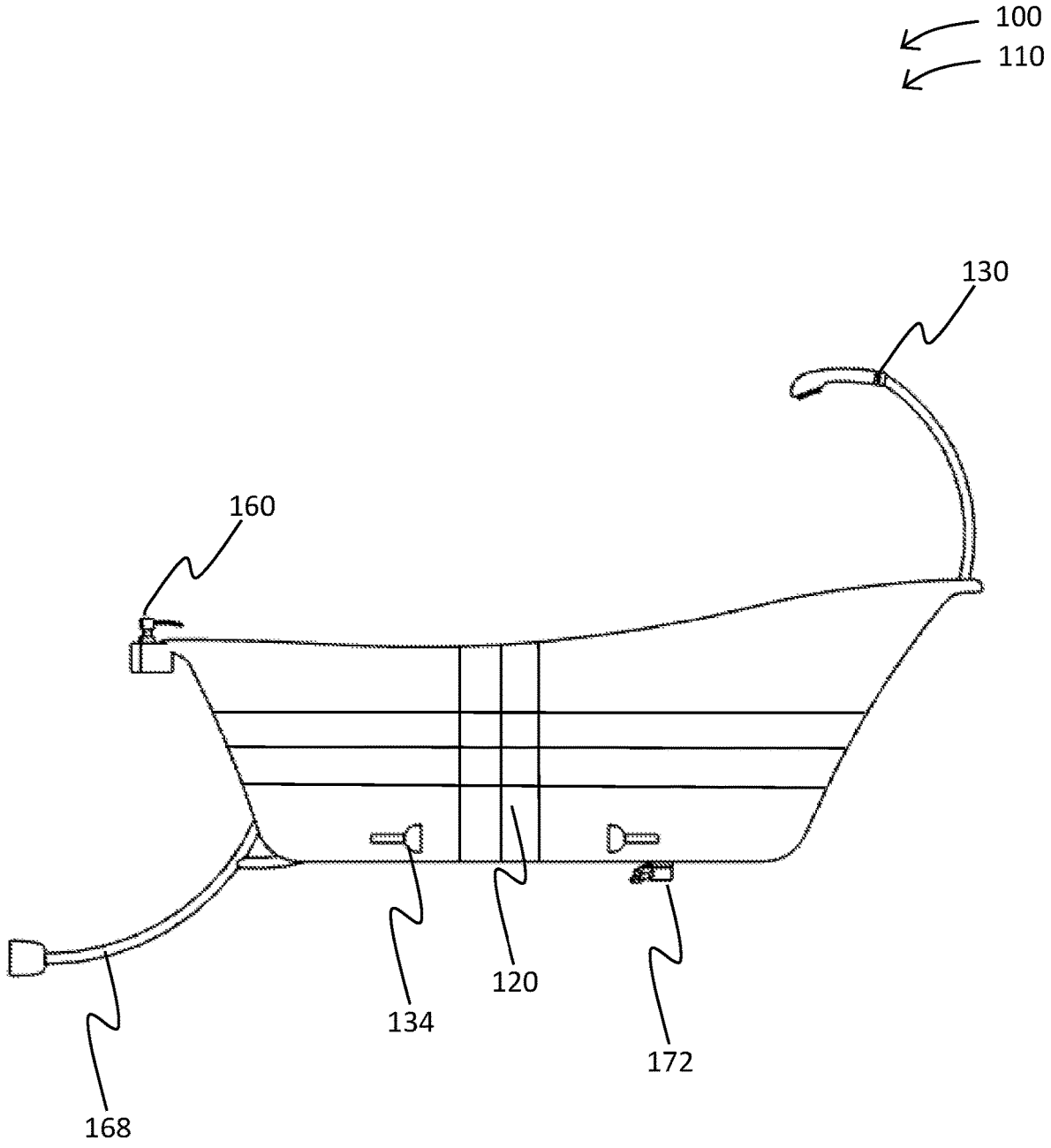
FIG. 3 is a perspective view of the baby bath system of FIG. 1, according to an embodiment of the present disclosure.

Referring now to FIG. 3 showing a perspective view of the baby bath system 100 of FIG. 1, according to an embodiment of the present disclosure. As above, the baby bath system 100 may include the tub 120, the shower head 130, the plurality of height adjustable legs 134, the dispenser 160, the hose 168, and the drain 170. The tub 120 further comprises four leg recesses 180. Each of the leg recess 180 is configured to store a respective one of the plurality of height adjustable legs 134 when collapsed. The first-end 136 of each of the plurality of height adjustable legs 134 is configured to pivot and fold the plurality of height adjustable legs 134 into the respective leg recess 180.

Figure 4:
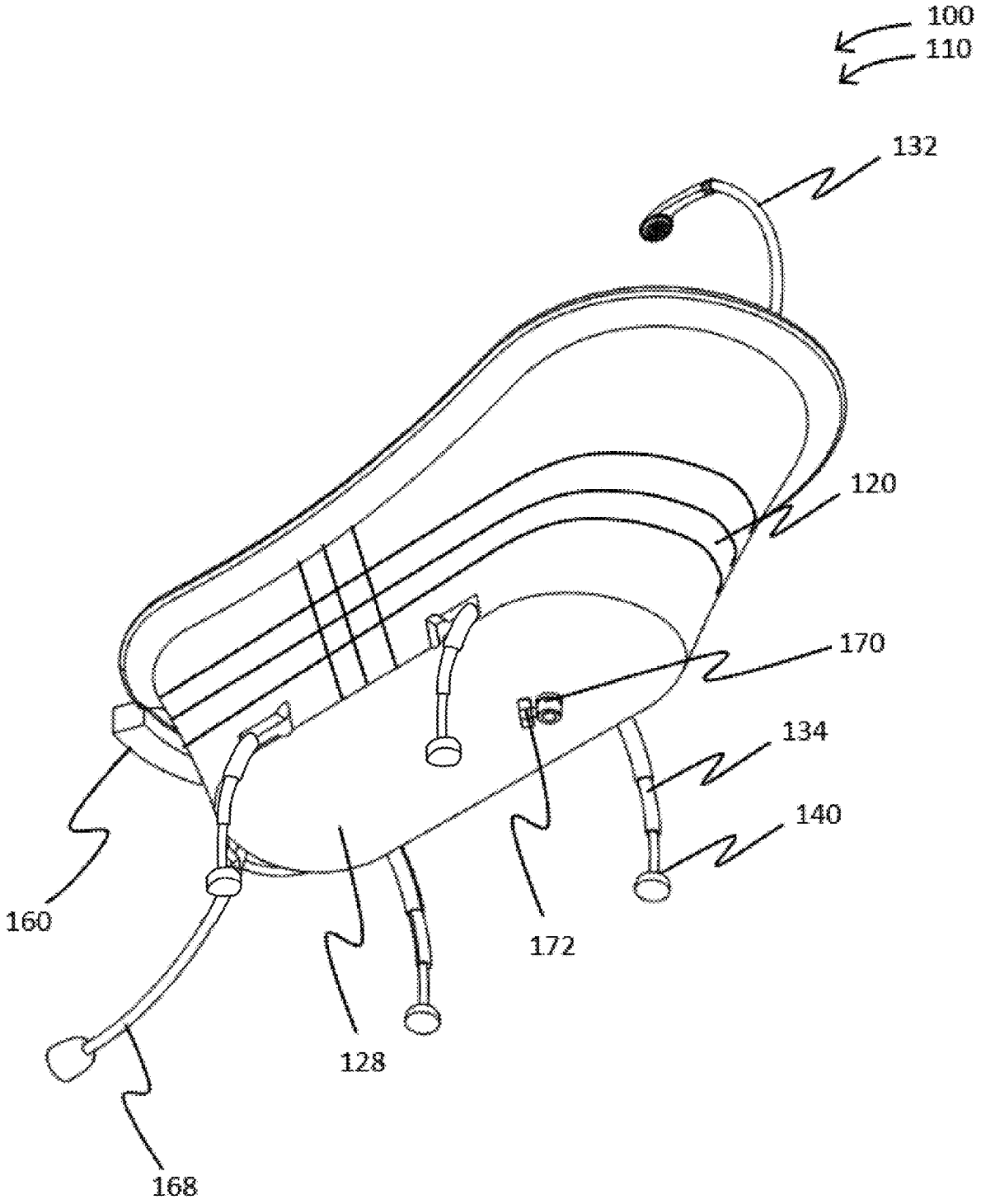
FIG. 4 is a perspective view of the baby bath system of FIG. 1, according to an embodiment of the present disclosure.

FIG. 4 shows a perspective view of the baby bath system 100 of FIG. 1, according to an embodiment of the present disclosure. As above, the baby bath system 100 may include the tub 120, the shower head 130, the plurality of height adjustable legs 134, the dispenser 160, the hose 168, and the drain 170. The dispenser 160 is a liquid-dispenser for dispensing the at least one liquid such as soap or shampoo. The dispenser 160 may be positioned on one of said plurality of side walls 124 of the tub 120 for access to soap or shampoo while bathing a baby. The hose 168 is a universal water filler and is configured to attach to a bathtub faucet and fill the tub 120 for use. The hose 168 further comprises a water shut-off valve 169 for the tub 120. Each of height adjustable legs 134 has a curvature 230. Each of height adjustable legs 134 are telescopic, and each telescope through the curvature 230. Accordingly, each of the height adjustable legs 134 includes at least two curved telescoping components 240 that nest within each other. Further, tub 120 further comprises four leg recesses 140. Each of the four leg recesses 140 comprises a T-shaped receptacle 200, such that a central channel 210 of the T-shaped receptacle is disposed horizontally along a lateral side 220 of tub 120. In this way, T-shaped receptacle may house height adjustable legs 134 along with suction cups 140 when they are folded up into a non-use configuration. For the purposes of this specification, "horizontally" indicates within ten degrees of parallel with base 128 of tub 120.

Figure 5:
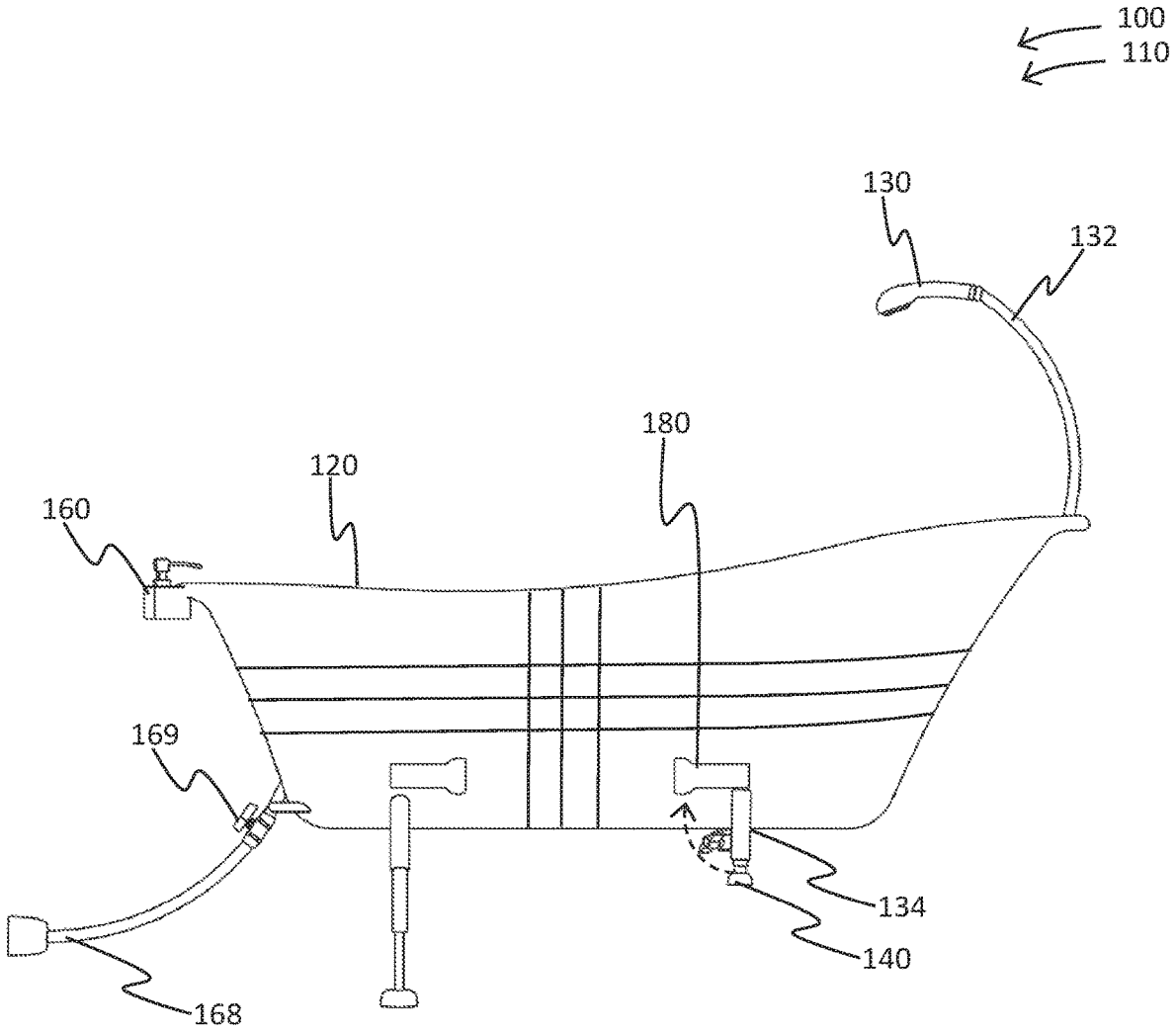
FIG. 5 is a perspective view of the baby bath system of FIG. 1, according to an embodiment of the present disclosure.

Referring now to FIG. 5 showing another perspective view of the baby bath system 100 of FIG. 1, according to an embodiment of the present disclosure. As above, the baby bath system 100 may include the bathing station assembly 110 including the tub 120 having the inner-volume 122, the plurality of side walls 124, the open top end 126, and the base 128, the shower head 130, the plurality of height adjustable legs 134, the dispenser 160, the hose 168, and the drain 170. The shower head 130 includes a shower-head-hose 132 connecting the shower head 130 to the tub 120. The shower-head-hose 132 receives the water from the hose 168 when connected to the water source. The drain 170 comprises a sealing mechanism 172 configured to open and alternatively close the drain 170 as desired. Sealing means such as gaskets or other suitable equivalent means may be used to enable the present invention to be adjustable relative to itself (via sliding components up, down, side-to-side or the like) yet retain water when filled.

The embodiments of the invention described herein are exemplary and numerous modifications, variations and rearrangements can be readily envisioned to achieve substantially equivalent results, all of which are intended to be embraced within the spirit and scope of the invention. Further, the purpose of the foregoing abstract is to enable the U.S. Patent and Trademark Office and the public generally, and especially the scientist, engineers and practitioners in the art who are not familiar with patent or legal terms or phraseology, to determine quickly from a cursory inspection the nature and essence of the technical disclosure of the application.

What is claimed is new and desired to be protected by Letters Patent is set forth in the appended claims:

1. A baby bath system, the baby bath system comprising:
a bathing station assembly including
a tub having
a base; and
a drain;
a shower head;
a plurality of height adjustable legs each having a curvature;

a dispenser;

a hose able to join in fluid communication with a water source; and wherein said tub further comprises four leg recesses, each of the four leg recesses comprising a T-shaped receptacle, such that a central channel of the T-shaped receptacle is disposed horizontally along a lateral side of the tub;

wherein each of said plurality of height adjustable legs include a length defined between a first-end and a second-end;

wherein said tub is configured to be filled with water via said hose, when said hose is connected to a water source during use;

wherein said shower head includes a shower-head-hose connecting said shower head to said tub;

wherein said shower-head-hose receives said water from said hose when the hose is connected to said water source;

wherein said hose is configured to attach to a bathtub faucet and fill said tub for use;

wherein said hose further comprises a water shut-off valve for said tub;

wherein said drain is configured at said base of said tub;

wherein said drain comprises a sealing mechanism configured to alternatively open and close said drain as desired;

wherein said dispenser is a liquid-dispenser for dispensing said at least one liquid;

wherein said plurality of height adjustable legs are fixed to opposing corners of said tub at said first-end to provide stable support to said tub;

wherein each of said plurality of height adjustable legs comprise a suction cup at a said second-end;

wherein each of said plurality of height adjustable legs are telescopic, and each of said plurality of height adjustable legs telescope through the curvature, each of the said plurality of height adjustable legs comprising at least two curved telescoping components;

wherein each of said plurality of height adjustable legs are retractable;

wherein each of said plurality of height adjustable legs are retracted during a non-use condition;

wherein each of said plurality of height adjustable legs are extended during an in-use condition;

wherein each of said plurality of height adjustable legs vertically extend from said base of said tub;

wherein each leg recess is configured to store a respective one of said plurality of height adjustable legs when retracted; and wherein each first-end of said plurality of height adjustable legs is configured to pivot and fold a respective one of said plurality of height adjustable legs into a respective one of said leg recesses.

* * * * *